US006499401B1

(12) United States Patent
Koch et al.

(10) Patent No.: US 6,499,401 B1
(45) Date of Patent: Dec. 31, 2002

(54) METHOD AND DEVICE FOR ABSORBING TORSIONAL VIBRATIONS OF A PRINTING MACHINE

(75) Inventors: Oliver Koch, Heidelberg (DE); Michael Merz, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/540,936

(22) Filed: Mar. 31, 2000

(30) Foreign Application Priority Data

Mar. 31, 1999 (DE) ..... 199 14 613

(51) Int. Cl.[7] ..... B41F 1/66
(52) U.S. Cl. ..... 101/484; 101/483
(58) Field of Search ..... 101/484, DIG. 24, 101/DIG. 26, 483

(56) References Cited

U.S. PATENT DOCUMENTS

| | | | | |
|---|---|---|---|---|
| 2,581,656 A | | 1/1952 | Harless | |
| 3,058,371 A | | 10/1962 | Haushalter | |
| 4,039,873 A | | 8/1977 | Gensheimer | |
| 4,073,047 A | * | 2/1978 | Fishbaugh et al. | 29/235 |
| 4,854,236 A | * | 8/1989 | Thunker et al. | 101/411 |
| 4,980,623 A | * | 12/1990 | Anton | 318/432 |
| 5,161,655 A | * | 11/1992 | Shimoda | 188/268 |
| 5,235,909 A | * | 8/1993 | Gerstenberger et al. | 101/216 |
| 5,324,248 A | * | 6/1994 | Quigley | 29/895.21 |
| 5,410,228 A | * | 4/1995 | Shibata et al. | 318/432 |
| 5,595,117 A | * | 1/1997 | Chrigui | 101/212 |
| 5,752,443 A | | 5/1998 | Dawley | |
| 5,794,529 A | | 8/1998 | Dawley et al. | |
| 6,000,298 A | * | 12/1999 | Kato | 74/569 |

FOREIGN PATENT DOCUMENTS

| | | |
|---|---|---|
| DE | 25 16 462 A1 | 10/1976 |
| DE | 130 321 | 3/1978 |
| DE | 35 29 687 A1 | 3/1987 |
| DE | 196 19 142 A1 | 3/1997 |
| DE | 197 15 026 A1 | 11/1997 |
| EP | 0 592 850 B1 | 4/1994 |
| FR | 2 286 983 | 4/1976 |
| GB | 2 046 873 A | 11/1980 |
| GB | 2 170 882 A | 8/1986 |

OTHER PUBLICATIONS

McGraw–Hill Dictionary of Scientific and Technical Terms, 5[th] Edition, Sybil Parker, p. 2046, 1994.*

* cited by examiner

*Primary Examiner*—Daniel J. Colilla
*Assistant Examiner*—Charles H. Nolan, Jr.
(74) *Attorney, Agent, or Firm*—Laurence A. Greenberg; Werner H. Stemer; Ralph E. Locher

(57) ABSTRACT

A method for absorbing torsional vibrations of a printing machine, wherein at least one torsional vibration-absorbing element acts upon a gearwheel train of the printing machine, includes determining a first characteristic form and characteristic frequency of a printing machine, and assigning to at least one shaft journal of a gearwheel whereon highest amplitudes of the first characteristic frequency occur, a passive torsional vibration absorber modulated to reductions of the first characteristic frequency; and a device for performing the method.

17 Claims, 3 Drawing Sheets

METHOD AND DEVICE FOR ABSORBING TORSIONAL VIBRATIONS OF A PRINTING MACHINE

BACKGROUND OF THE INVENTION

Field of the Invention

The invention relates to a method and a device for absorbing torsional vibrations of a printing machine, in which at least one element absorbing torsional vibrations acts upon a gearwheel train of the printing machine.

Various types of vibrations influencing print quality occur on printing machines. Sources for the origin of vibrations are cylinder gaps or channels, sheet transfer elements and other discontinuously operating machine elements. This leads, for one, to bending vibrations in rollers and cylinders, however, also to torsional vibrations of cylinders or drums. The torsional vibrations are propagated mostly via the gearwheels of the gearwheel train and, as a rule, attain higher amplitudes with an increase in distance from the drive. Such vibrations may occur angle-synchronously or asynchronously.

Bending vibrations are controlled, on the one hand, by a sturdy form of construction and, on the other hand, by arranging damping or absorbing elements in the cylinders. For the control of torsional vibrations, the published European Patent Document EP 0 592 850 B1 discloses a device and method for providing active actuating elements, for example, motors, on the individual cylinders, in order, by measurements and controls, to activate the motors so that regulating forces which damp the vibrations are generated. This measure entails a considerable outlay in sensor technology and regulating and actuating elements. Most torsional vibrations occur angle-synchronously, vibrations of the first order occurring once and vibrations of further orders more than once per revolution. Vibrations of the first and second orders are usually the most pronounced and have to be reduced, because they may give rise, in the resonant ranges, to mackling problems which depend upon the machine speed.

SUMMARY OF THE INVENTION

It is accordingly an object of the invention to provide a method and a device for absorbing torsional vibrations of a printing machine wherein speed-dependent mackling problems are reduced as much as possible.

With the foregoing and other objects in view, there is provided, in accordance with one aspect of the invention, a method for absorbing torsional vibrations of a printing machine, wherein at least one torsional vibration-absorbing element acts upon a gearwheel train of the printing machine, which comprises determining a first characteristic form and characteristic frequency of a printing machine, and assigning to at least one shaft journal of a gearwheel, whereon highest amplitudes of the first characteristic frequency occur, a passive torsional vibration absorber modulated to reductions of the first characteristic frequency.

In accordance with another mode, the method of the invention comprises measuring the second characteristic form and characteristic frequency of a printing machine, and assigning to the at least one shaft journal of the gearwheel, whereon the highest amplitudes of the second characteristic frequency occur, a passive torsional vibration absorber modulated to the reduction of this second characteristic frequency.

In accordance with a further mode, the method of the invention includes selecting properties of the torsional vibration absorbers according to the measured values, so that absorption and damping of the torsional vibrations are achieved.

In accordance with another Aspect of the invention, there is provided a device for absorbing torsional vibrations of a printing machine, wherein at least one vibration-absorbing element is actable upon a gearwheel train of the printing machine, comprising a passive torsional vibration absorber arranged in the vicinity of the gearwheel on at least one shaft journal of cylinders or drums drivable by the gearwheel train.

In accordance with another feature of the invention, the torsional vibration absorbers are arranged at locations on the gearwheel train at which highest torsional vibration amplitudes occur.

In accordance with a further feature of the invention, in a machine having a plurality of printing units and a drive in a region of the middle of the machine, at least one torsional vibration absorber is assigned to each force transmission side.

In accordance with an added feature of the invention, the at least one torsional vibration absorber is arranged and dimensioned for reducing a first characteristic frequency.

In accordance with an additional feature of the invention, at least another torsional vibration absorber is arranged and dimensioned for reducing a second characteristic frequency.

In accordance with yet another feature of the invention, the torsional vibration absorber is a damped absorber.

In accordance with yet a further feature of the invention, the damped torsional vibration absorber is formed of at least one mass and of at least one elastomer that is inserted between a carrier and the mass, the elastomer having spring and damping properties.

In accordance with yet an added feature of the invention, the damped absorber is formed of at least one mass and of spring elements and damping elements arranged between the mass and a carrier.

In accordance with yet an additional feature of the invention, the damping elements are disposed for acting in a circumferential direction.

In accordance with still another feature of the invention, the damping elements are cylinders with pistons, the pistons being formed with respective clearances through which a damping medium is flowable.

In accordance with still a further feature of the invention, the spring elements are arranged for acting in a circumferential direction.

In accordance with still an added feature of the invention, the torsional vibration absorbers are constructed as two-stage torsional vibration absorbers for reducing first and second characteristic forms and characteristic frequencies of the printing machine.

In accordance with a concomitant feature of the invention, the device comprises first springy and damping elements arranged between a carrier and a mass, and second springy and damping elements arranged between the mass and a further mass, one of the springy and damping elements, together with the mass associated therewith, being constructed and dimensioned for reducing a first characteristic form and characteristic frequency, and the other springy and damping element, together with the mass associated therewith, being constructed and dimensioned for reducing a second characteristic form and characteristic frequency.

Thus the object of the invention is achieved, in a method of the type mentioned in the introduction hereto, in that the first characteristic form and characteristic frequency of a printing machine are determined, and in that at least one of the shaft journals of the gearwheels on which the highest amplitudes of the first characteristic frequency occur have assigned thereto a passive torsional vibration absorber modulated to the reductions of this first characteristic frequency.

The object is achieved, in a device of the type initially mentioned, in that a passive torsional vibration absorber is arranged in the vicinity of the gearwheel on at least one shaft journal of the cylinders or drums driven by the gearwheel train.

By virtue of the method according to the invention, essential causes of the mackling problems are determined in a concerted manner and are controlled simply and effectively in space and in time at the location where they occur. The first characteristic form and, if appropriate, further characteristic forms are determined, for example, by torsional vibration measurement and/or calculation. The vibrations are counteracted in their resonant ranges, i.e., when the characteristic forms and characteristic frequencies of the printing machine occur, in such a way that they are harmless to the printing process, and mackling errors can therefore no longer arise. This is performed by a corresponding modulation of the characteristic frequency of the mass of the torsional vibration absorber, the spring constant thereof and, if appropriate, the damping thereof, and also by arranging the torsional vibration absorbers at the critical locations on the gearwheel train.

The device according to the invention provides for constructing and arranging a torsional vibration absorber in order to achieve the aforementioned effect. In this case, the torsional vibration absorber is arranged in the vicinity of that gearwheel of the driven sheet-guiding element, a cylinder or drum, which is affected by the vibrations in such a way that the print quality may be impaired. The arrangement in the vicinity of the gearwheel ensures that the harmful vibration is eliminated before it acts upon the cylinder or the drum.

By virtue of the method and device, vibration reduction takes place in a frequency band around the first characteristic frequency along the entire drive train of the printing machine. It exerts an optimum effect at every set printing speed without any outlay in regulating terms and also without any sensor and actuator technology. There are therefore no longer any quality variations dependent upon the printing speed as a result of vibrations in the drive train.

In a further development of the method of the invention, the second characteristic form and characteristic frequency of a printing machine are also measured, and at least the shaft journals of the gearwheels on which the highest amplitudes of the second characteristic frequency occur have assigned thereto a passive torsional vibration absorber modulated to the reduction of this second characteristic frequency. A vibration reduction thereby also takes place in a frequency and around the second characteristic frequency along the entire drive train of the printing machine. Even further orders of characteristic frequencies may, of course, also be controlled in such a way, but, as a rule, it is sufficient to reduce the first and second characteristic frequencies in the way proposed.

Preferably, the properties of the torsional vibration absorbers are selected, according to the measured values, in such a way that absorption and damping of the torsional vibrations are achieved.

For absorbing the torsional vibrations, the device according to the invention provides for torsional vibration absorbers to be capable of being arranged at any desired location on the gearwheel train. Preferably, however, there is provision for arranging torsional vibration absorbers at those locations on the gearwheel train at which the highest torsional vibration amplitudes occur. Because the amplitudes, as a rule, become higher with increasing distance from the drive, it is expedient to arrange the torsional vibration absorbers on the shaft journals of those cylinders or drums which are farther away from the drive. In a machine having a plurality of printing units and a drive in the region of the middle of the machine, it is proposed that each force transmission side have assigned thereto at least one torsional vibration absorber.

Expediently, at least one torsional vibration absorber is arranged and dimensioned for reducing the first frequency. However, at least one further torsional vibration absorber may also be arranged and dimensioned for reducing the second characteristic frequency. This is expedient mostly because the second characteristic frequency, too, has an intensity which disturbs the print quality. Even higher orders of characteristic frequencies may, of course, be reduced in this way, but, as a rule, the reduction of the first and second orders is sufficient. Optimum vibration reduction is achieved if the torsional vibration absorber is a damped absorber. Absorbers of this type have a mass which is articulated at the critical points of the drive train by spring and damping elements.

One embodiment provides for the damped absorber to include at least one mass and at least one elastomer which is inserted between a carrier and the mass, the elastomer having spring and damping properties.

A second embodiment provides for the damped absorber to include at least one mass and spring elements and damping elements which are arranged between the mass and a carrier. In this case, the damping elements are expediently arranged so as to act in the circumferential direction. The damping elements may be cylinders with pistons, in which case a damping medium can flow through a clearance or gap of the piston. The spring elements, too, are expediently arranged so as to act in the circumferential direction.

One development provides for constructing a torsional vibration absorber as a two-stage torsional vibration absorber for reducing the first and second characteristic forms and characteristic frequencies of the printing machine. There may, for example, be provision for arranging first springy and damping elements between the carrier and the mass, and for arranging second springy and damping elements between the mass and a further mass, in which case one of the springy and damping elements, together with the associated mass, is constructed and dimensioned for reducing the first characteristic form and characteristic frequency, and the other springy and damping element, together with the associated mass, is constructed and dimensioned for reducing the second characteristic form and characteristic frequency.

Even further embodiments may, of course, be contemplated, for example the damped torsional vibration absorbers may be arranged on the cylinder journals independently of one another in order to control the first and second characteristic frequencies. It is also possible to arrange both absorbers next to one another on the same flange and to assign a double absorber of this kind to a cylinder or a drum.

Other features which are considered as characteristic for the invention are set forth in the appended claims.

Although the invention is illustrated and described herein as embodied in a method and device for absorbing torsional vibrations of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
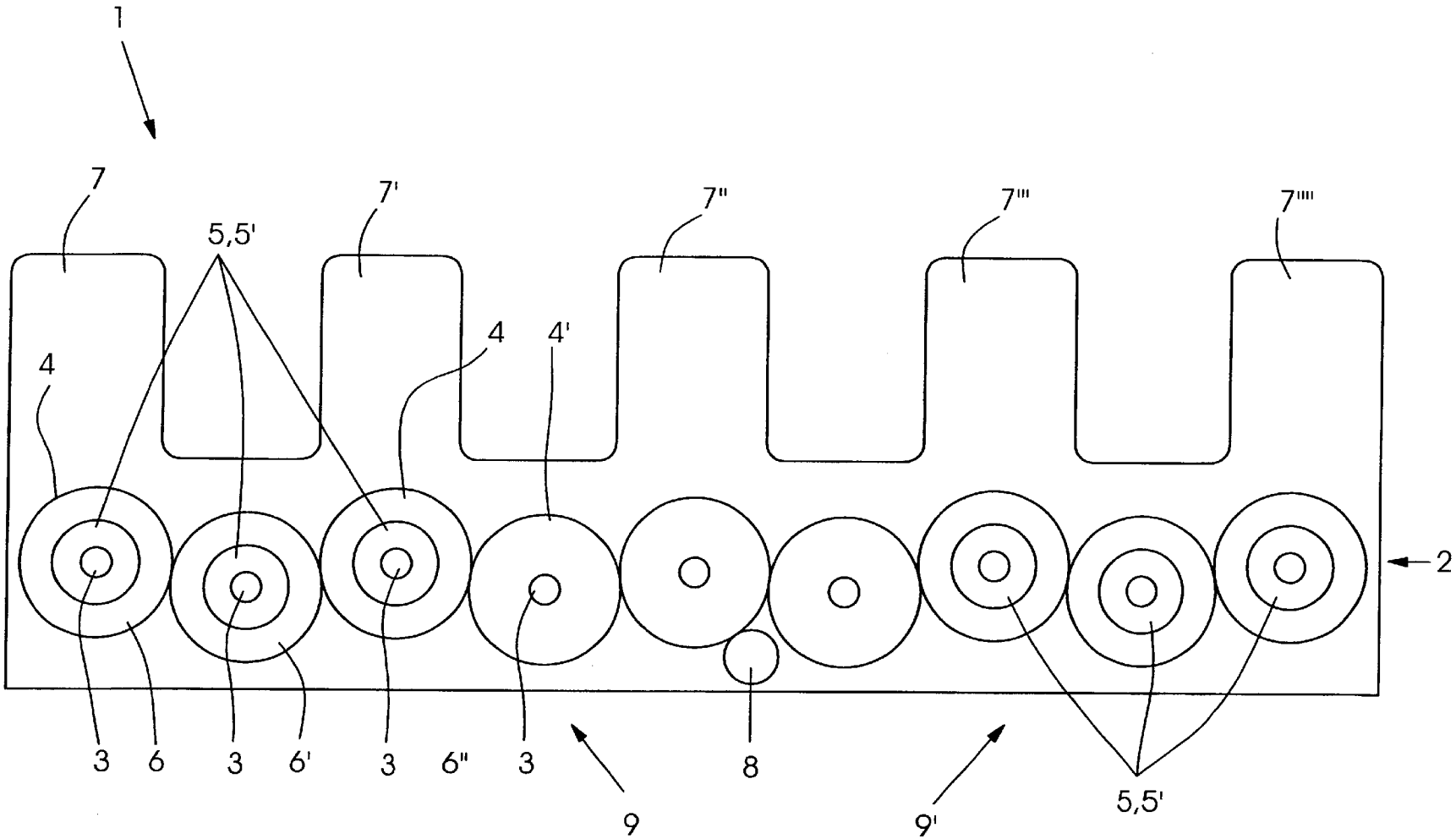
FIG. 1 is a highly diagrammatic side elevational view of a printing machine having the torsional vibration absorption capability according to the invention.

Referring now to the drawings and, first, particularly to FIG. 1 thereof, there is shown therein a printing machine 1 with the torsional vibration absorption capability according to the invention. The printing machine 1 is made up of five printing units 7, 7',7",7'",7"" which are driven by a drive 8 via a gearwheel train 2. The number of printing units is, of course, merely by way of example. The drive 8 is expediently arranged in the middle region of the printing machine 1, in order to keep the moments of force to be transmitted as low as possible. Each printing unit 7, 7', 7", 7'", 7"" has an impression cylinder 4 assigned thereto and, between the printing units, drums 4' are provided for transferring the sheets from one printing unit to another. The cylinders 4 and the drums 4' are equipped with gearwheels 6, 6', 6", and so forth, which engage or mesh with one another to form the gearwheel train 2. When torsional vibrations occur in a printing machine 1 of this type, they are, as a rule, low at the drive 8 and become greater with an increase in distance from the drive 8.

From a printing machine 1 of this type, by torsional vibration measurement, the first and, if appropriate, also the second characteristic form and characteristic frequency and also the location at which they occur are determined, in order to use passive torsional vibration absorbers 5 and 5' modulated to this characteristic frequency and characteristic form at defined locations. In the machine that is illustrated in FIG. 1, torsional vibration absorbers 5 and 5' of this type have been used on one or more outer printing units 7, 7', 7'" and 7"". In a machine of this type with a drive 8 in the middle region, each force transmission side 9 and 9' should regularly have at least one torsional vibration absorber 5 and 5' assigned thereto.

Figure 2:
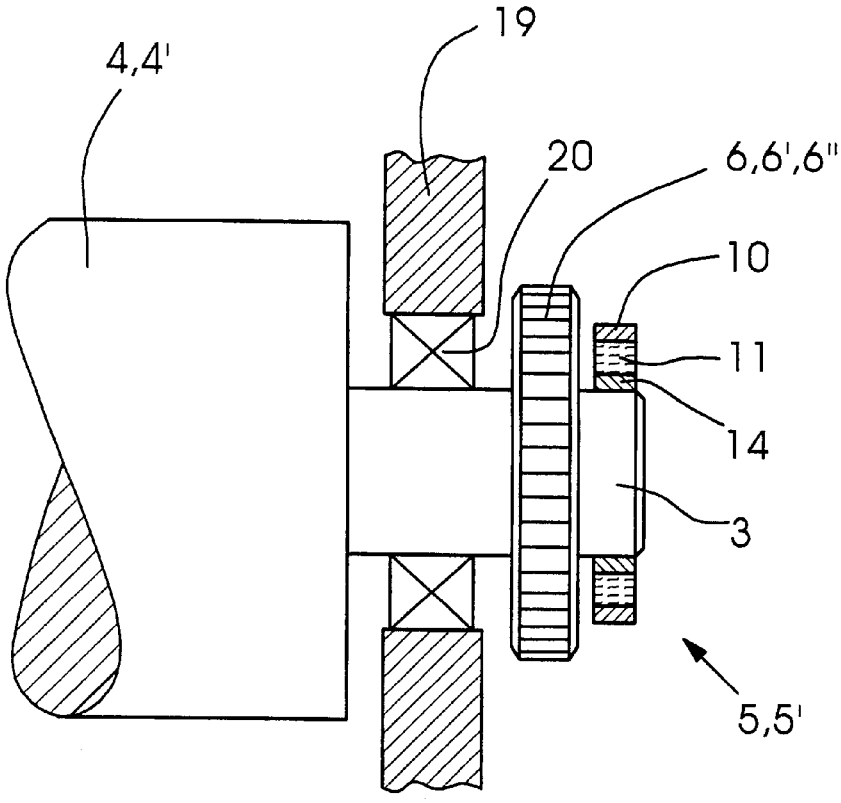
FIG. 2 is a fragmentary front elevational view, partly in section, of FIG. 1, showing an arrangement of a first exemplary embodiment of a torsional vibration absorber according to the invention.

FIG. 2 shows the arrangement of a first exemplary embodiment of a torsional vibration absorber 5 or 5'. It illustrates a cylinder 4 or a drum 4' which is mounted on both sides in the side walls 19 of the printing machine by bearings 20. The side wall 19 of the driving side is illustrated. The gearwheel 6, 6', 6", etc., which is driven via the gearwheel train 2 of the printing machine 1, is located on the shaft journal 3 on this side. Insofar as respective amplitudes of the characteristic frequency have been measured for this cylinder 4 or this drum 4', the shaft journal 3 is provided, according to the invention, with a torsional vibration absorber 5 or 5'.

The first exemplary embodiment of the torsional vibration absorber 5, 5', as illustrated in FIG. 2, is formed of a carrier 14, for example, a flange, which is mounted on the shaft journal 3. Located on this carrier 14 is an elastomer 11 carrying a mass 10 in the form of a ring. The elastomer 11 is formed so as to have absorbing and damping properties.

Figure 3:
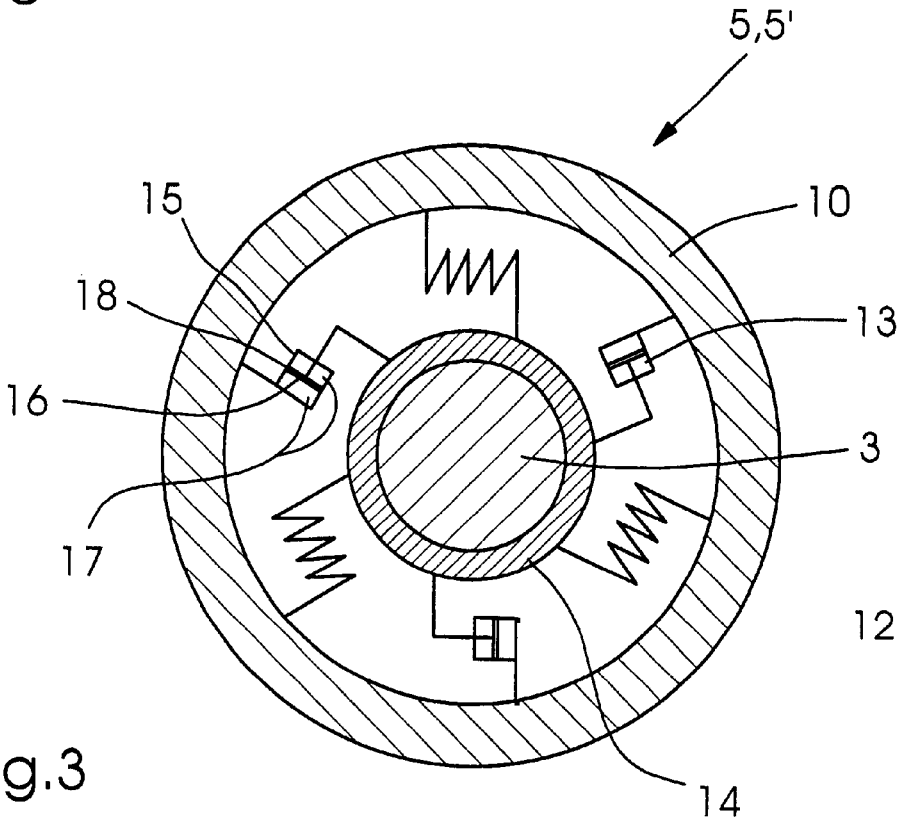
FIG. 3 is a diagrammatic and schematic end view, partly in section, of a second exemplary embodiment of the torsional vibration absorber.

FIG. 3 shows a second exemplary embodiment of the torsional vibration absorber 5, 5'. In contrast with the first exemplary embodiment, in the second exemplary embodiment, the absorption properties are achieved by actual spring elements 12, and the damping properties by actual damping elements 13. As in the first exemplary embodiment described hereinbefore, the elements 12 and 13 are arranged between a flange-like carrier 14 and a mass 10, in the second embodiment. The damping elements 13 are formed of closed cylinders 15, wherein pistons 16 run, the pistons 16 being formed with a gap or clearance 18, through which a damping medium 17 can flow from one space to the other.

Figure 4:
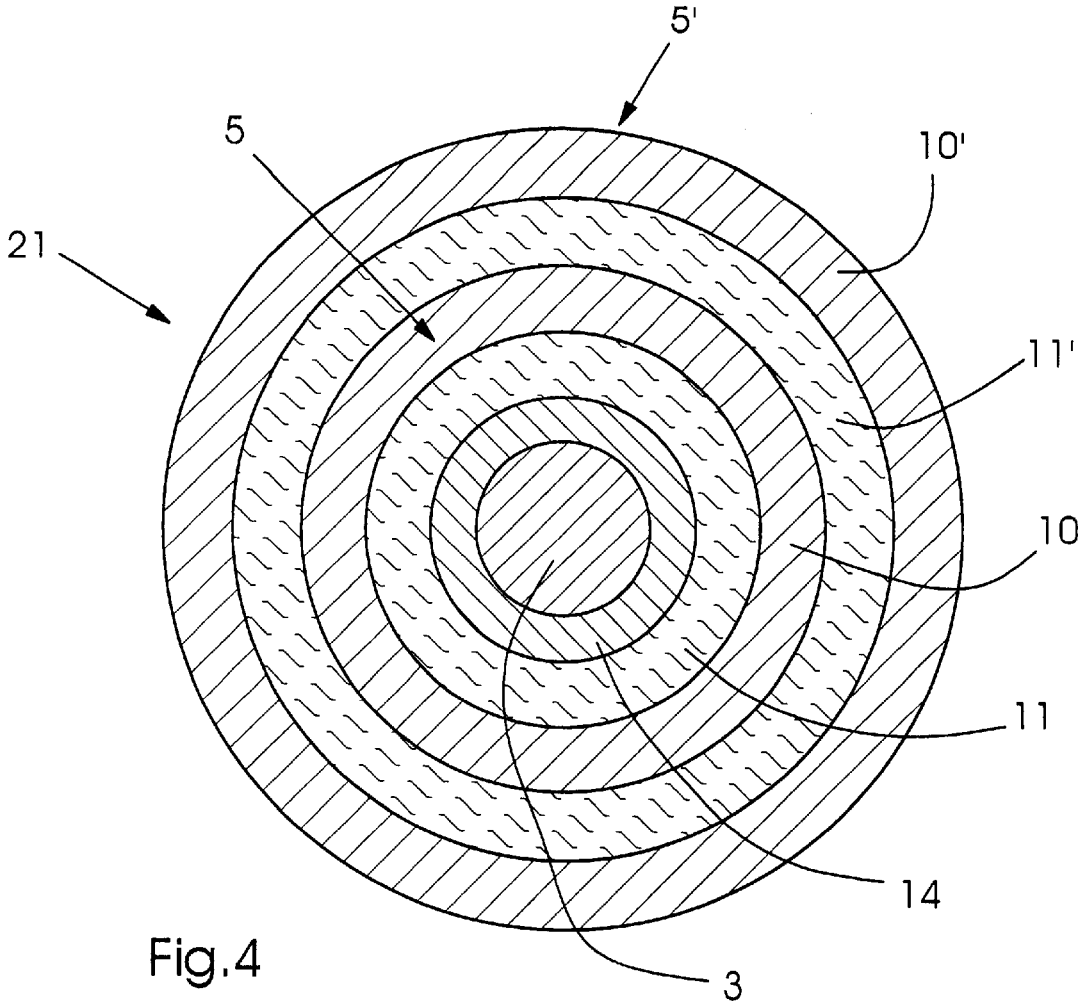
FIG. 4 is a cross-sectional view of a first exemplary embodiment of a two-stage torsional vibration absorber according to the invention.

FIG. 4 shows a first exemplary embodiment of a two-stage torsional vibration absorber 21. In the first place, as in the exemplary embodiment of FIG. 2, a carrier 14 together with an elastomer 11 and a mass 10 is arranged on a shaft journal 3. This is the torsional vibration absorber 5 or 5' for reducing the vibrations of one order. Located on the mass 10 is a further elastomer 11' with a further mass 10'. This is a further torsional vibration absorber 5 or 5' for reducing the other order of vibrations. A vibration having amplitudes of the first and second orders can be reduced in this manner by a two-stage torsional vibration absorber 21.

Figure 5:
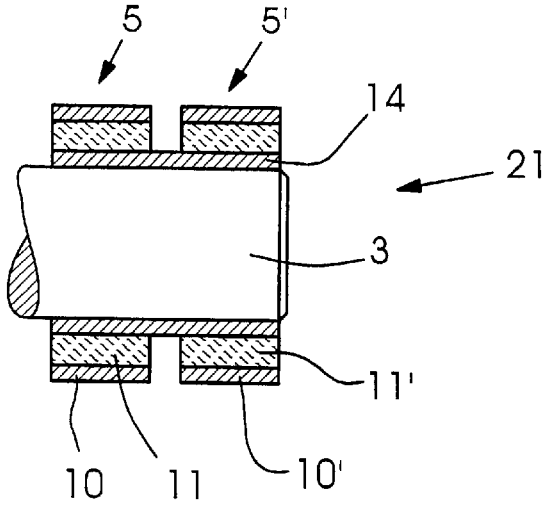
FIG. 5 is a fragmentary longitudinal sectional view of a second exemplary embodiment of the two-stage torsional vibration absorber.

FIG. 5 shows a second exemplary embodiment of a two-stage torsional vibration absorber 21. In FIG. 5, the two torsional vibration absorbers 5 and 5' are shown arranged next to one another on a carrier 14.

The invention can also be implemented by many other embodiments, for example the two-stage torsional vibration absorbers of FIGS. 4 and 5 may be constructed in the same way as the torsional vibration absorber 5, 5' illustrated in FIG. 3 and described hereinabove. It is also possible, however, to arrange separately on the shaft journals 3, torsional vibration absorbers 5 for the first characteristic form and characteristic frequency and torsional vibration absorbers 5' for the second characteristic form and characteristic frequency of the printing machine. In this case, they may be arranged partially on the same shaft journals 3 or on different shaft journals 3. Further embodiments of the damping elements 13 and spring elements 12 are also conceivable, or a version wherein a mass 10 or 10' is seated in the form of a disk on the end face of the shaft journal 3, with an absorbing and/or damping element 11, 11', 12, 13 being inserted.

We claim:

1. A method for absorbing torsional vibrations of a printing machine, which comprises:

providing a printing machine having a gearwheel train and a plurality of printing units;

determining a first characteristic form and characteristic frequency that are caused by the plurality of the printing units;

mounting on at least one shaft journal of a gearwheel, whereon highest amplitudes of the first characteristic frequency occur, a passive torsional vibration absorber modulated to reduce the first characteristic frequency; and dimensioning and configuring the torsional vibration absorber for reducing the first characteristic frequency.

2. The method according to claim 1, which comprises measuring a second characteristic form and characteristic frequency of the printing machine, and assigning to the at least one shaft journal of the gearwheel whereon the highest amplitudes of the second characteristic frequency occur, a passive torsional vibration absorber modulated to reduce this second characteristic frequency.

3. The method according to claim 1, which includes selecting properties of the torsional vibration absorbers according to the measured values, so that absorption and damping of the torsional vibrations are achieved.

4. A device for absorbing torsional vibrations of a printing machine having a plurality of printing units and a gearwheel train, comprising a passive torsional vibration absorber arranged in the vicinity of the gearwheel train on at least one shaft journal of cylinders or drums drivable by the gearwheel train, said passive torsional vibration absorber arranged and dimensioned for reducing a first characteristic frequency caused by the plurality of the printing units.

5. The device according to claim 4, comprising a plurality of torsional vibration absorbers that are arranged at locations on the gearwheel train at which highest torsional vibration amplitudes occur.

6. The device according to claim 4, comprising a plurality of torsional vibration absorbers, at least one of said plurality of said vibration absorbers is assigned to each force transmission side of the printing machine.

7. The device according to claim 4, wherein at least another torsional vibration absorber is arranged and dimensioned for reducing a second characteristic frequency.

8. The device according to claim 4, wherein said torsional vibration absorber is a damped absorber.

9. The device according to claim 8, wherein said damped torsional vibration absorber is formed of at least one mass and of at least one elastomer that is inserted between a carrier and said mass, said elastomer having spring and damping properties.

10. The device according to claim 8, wherein said damped absorber is formed of at least one mass and of spring elements and damping elements arranged between said mass and a carrier.

11. The device according to claim 10, wherein said damping elements are disposed for acting in a circumferential direction.

12. The device according to claim 11, wherein said damping elements are cylinders with pistons, said pistons being formed with respective clearances through which a damping medium is flowable.

13. The device according to claim 10, wherein said spring elements are arranged for acting in a circumferential direction.

14. The device according to claim 4, wherein said torsional vibration absorbers are constructed as two-stage torsional vibration absorbers for reducing first and second characteristic forms and characteristic frequencies of the printing machine.

15. The device according to claim 4, comprising first springy and damping elements are arranged between a carrier and a mass, and second springy and damping elements are arranged between said mass and a further mass, one of said springy and damping elements, together with the mass associated therewith, being constructed and dimensioned for reducing a first characteristic form and characteristic frequency, and said other springy and damping element, together with the mass associated therewith, being constructed and dimensioned for reducing a second characteristic form and characteristic frequency.

16. The device according to claim 4, wherein said passive torsional vibration absorber is mounted external from said cylinders or said drums.

17. The method according to claim 1, which comprises:

using the shaft journal to support a cylinder; and when mounting the passive torsional vibration absorber on the shaft journal, mounting the passive torsional vibration absorber external from the cylinder.

* * * * *